US005951405A

United States Patent [19]

Eigenmann

[11] Patent Number: 5,951,405

[45] Date of Patent: Sep. 14, 1999

[54] SYSTEM AND METHOD FOR THE REALIZATION OF SCENOGRAPHIC AND DECORATIVE EFFECTS BY MEANS OF LUMINOUS PROJECTION OF WAVES OF LIQUID

[76] Inventor: Helmut Eigenmann, Via Bertoni, 19, 6903 Lugano, Switzerland

[21] Appl. No.: 09/011,775

[22] PCT Filed: Aug. 26, 1996

[86] PCT No.: PCT/EP96/03750

§ 371 Date: Feb. 24, 1998

§ 102(e) Date: Feb. 24, 1998

[87] PCT Pub. No.: WO97/07994

PCT Pub. Date: Mar. 6, 1997

[30] Foreign Application Priority Data

Aug. 31, 1995 [IT] Italy ..... MI95A1833 U

[51] Int. Cl.[6] ..... A63J 5/02

[52] U.S. Cl. ..... 472/61; 472/63

[58] Field of Search ..... 472/61, 63, 57, 472/65, 128, 129, 137; 362/101

[56] References Cited

U.S. PATENT DOCUMENTS

| | | | |
|---|---|---|---|
| 3,613,264 | 10/1971 | Vitka et al. | 472/61 |
| 4,985,811 | 1/1991 | Weiner | 362/101 |
| 5,678,918 | 10/1997 | Lin | 362/96 |
| 5,779,552 | 7/1998 | Gelfond et al. | 472/67 |

FOREIGN PATENT DOCUMENTS

| | | |
|---|---|---|
| 3-138802 | 6/1991 | Japan . |
| 5-004500 | 5/1993 | Japan . |
| 5-224615 | 9/1993 | Japan . |

OTHER PUBLICATIONS

Patnet Abstracts of Japan, vol. 015, No. 354 (M–1155), Sep. 6, 1991.

Patent Abstracts of Japan, vol. 017, No. 268 (M1416), May 25, 1993.

Patent Abstracts of Japan, vol. 017, No. 673, (P–1658), Dec. 10, 1993.

*Primary Examiner*—Kien T. Nguyen
*Attorney, Agent, or Firm*—Thelen Reid & Priest L.L.P.

[57] ABSTRACT

The present invention concerns an opto-mechanical system and method for obtaining scenographic and decorative effects on surfaces suitable as screens. The system includes a container of liquid, such as water and a movable planar element placed inside said container. An actuator is provided for variably displacing the movable planar element relative to the liquid to generate a variety of movements of waves above the upper face of the movable planar element, while a light source is placed relative to the container to project the movements of the waves onto the surfaces. The movable planar element can also be displaced manually. The system permits the creation of a great variety of wave design patterns due to the displacements of the movable planar element inside the container of liquid.

19 Claims, 5 Drawing Sheets

SYSTEM AND METHOD FOR THE REALIZATION OF SCENOGRAPHIC AND DECORATIVE EFFECTS BY MEANS OF LUMINOUS PROJECTION OF WAVES OF LIQUID

BACKGROUND OF THE INVENTION

1. Field of the Invention

The present invention is directed to a system for obtaining visual effects of walls and other surfaces by luminous projection of movements of waves of a liquid onto the walls or surfaces.

2. Description of Related Art

The demand for new scenographic, stage, decorative effects to be used for shows, for mundane or cultural events but also for special and attractive permanent settings of public and private places is strongly growing, as a consequence of modern societies' way of "living with the eyes", the eyes being receptors for man's mind desirous of ever more spectacularity, emotions, escape from the patterns of daily routine life.

Another recent trend relevant in the present context is the use of visual effects for assisting stressed people to relax, to isolate themselves from the external world, to "find the inner harmony" as "wellness" experts like to say.

Many, if not the majority, of such scenographic and decorative effects use, as supporting element on which the visual effect is formed, surfaces of different nature, size and spatial orientation.

In certain cases the device generating the visual effect is incorporated in such surface, e.g. in the case of panels comprising light emitting diodes controlled by computers apt to generate an endless variety of designs and to program their timing. Inherently these devices have a high cost per surface unit, they produce technologically looking images, and it is difficult to incorporate them in an ambient setting when they are not in operative use.

A more versatile and generally less expensive technique consists in the luminous projection on walls or other surfaces by means of a suitable light source or by using a colour TV projector. With the first technique we can obtain sequences of steady or stiff images displaced inside a spatial setting, like the projectors used in discos and theaters or, alternatively, laser beams controlled by computers. The resulting visual impression for the observer is a combination of designs, shapes, luminous points or spots which move on surfaces, the nature of such surfaces, as perceived by the observer, being unchanged. The last problem could be overcome with colour TV projection, but there are still, at present, limitations as to quality and dimension of projected images, and high costs. Moreover, such images are in any case perceived as what they are, i.e. TV or video images, with an appearance and impression of artificiality, electronic processing, lack of immediacy.

From what has been said it is evident that there is an interest in new techniques for the generation of scenographic and decorative effects which combine the advantages of "naturalness" of projected images, of maximum spatial versatility, i.e. generation of effects which are suitable for the simultaneous projection on surfaces of different spatial orientation, and of reasonable cost for the equipment needed.

A visual effect fascinating man is a natural phenomenon: the pattern design of water waves illuminated by the sun, and projected on the stony or sandy bottom. The scope of the present invention is the reproduction, on surfaces of different kind, of the design pattern generated by the motion of waves of liquid by means of a system whereby an endless variety of design patterns can be obtained, an example for such variety being the uninterrupted change from the clear design of low velocity wave impulses to more agitated liquid surface conditions such as high velocity and interfering wave trains.

SUMMARY OF THE INVENTION

Thus, in its broad aspect, the invention proposes a system for obtaining visual effects on walls and other surfaces apt to serve as screens, for scenographic, decorative and architectural uses and purposes, comprising the luminous projection, by means of a light source, of movements of waves of a liquid, onto said walls or screen surfaces, wherein said movements of waves are generated to occur above the upper face of a movable planar element placed inside a container of said liquid, said movable planar element arranged to be capable of variable displacements relative to said liquid subject to actuation by external drive or actuating means acting on said movable planar element, the variety of said displacements generating the desired variety of movements of said waves.

Following the teachings of the present invention it is possible to animate entire walls of a room and create a "liquid" setting: the observer feels himself surrounded by the waves of a river, a lake, by the backwash motion on a beach, in a very pleasant way due to the naturalness of the images as perceived by the observer. As a matter of fact it is the motion of the liquid itself, such as e.g. water, which is visualized by means of suitable light sources and optical devices.

BRIEF DESCRIPTION OF THE DRAWINGS

The invention will now be explained in more detail by way of the following description of preferred embodiments, in connection with the drawing, wherein.

DESCRIPTION OF THE PREFERRED EMBODIMENTS

Figure 1:
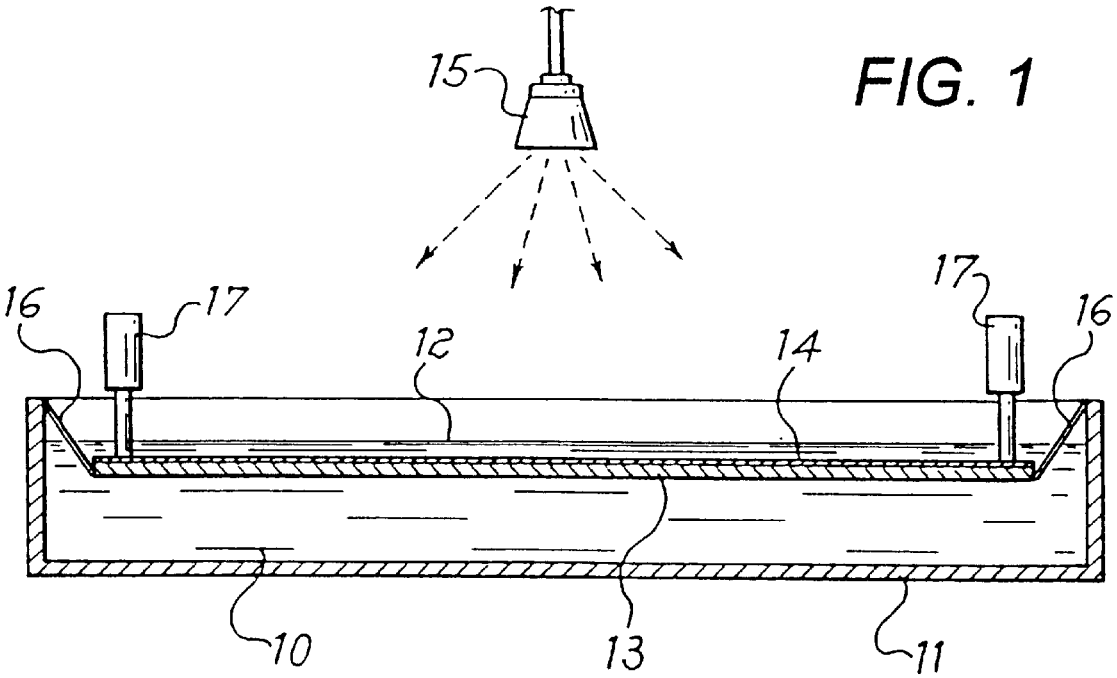
FIG. 1 shows in a schematic section a device and arrangement embodying the invention, in a non-operating condition of the system.

FIG. 1 shows, as an example, one of the preferred embodiments of the present invention in a non-operating condition.

A container 11 is filled with a liquid 10, the surface 12 of the liquid being shown in the rest or unactivated condition. An optical device 15 including a suitable light source generates a light beam directed onto the surface 12 of the liquid 10. A planar element 13 is placed inside the container 11. Such planar element 13 is fixed in a way to be able to continuously change its position with respect to the level of the liquid during operation of the system, i.e. its vertical distance from the liquid surface and its inclination.

Such change of position is obtained, as a non-limitative example, by 'anchoring' or connecting the planar element 13 to the rim of the container 11 by means of elastic elements 16, and by acting on the surface of the said planar element 13 with vertically oriented actuation rods or piston members 17 or other well-known mechanism for imparting motion. On its upper face the planar element 13 can comprise a mirror 14 having the function of reflecting the light rays towards the surface where it is desired to produce the visual effect of the present invention.

Figure 2:
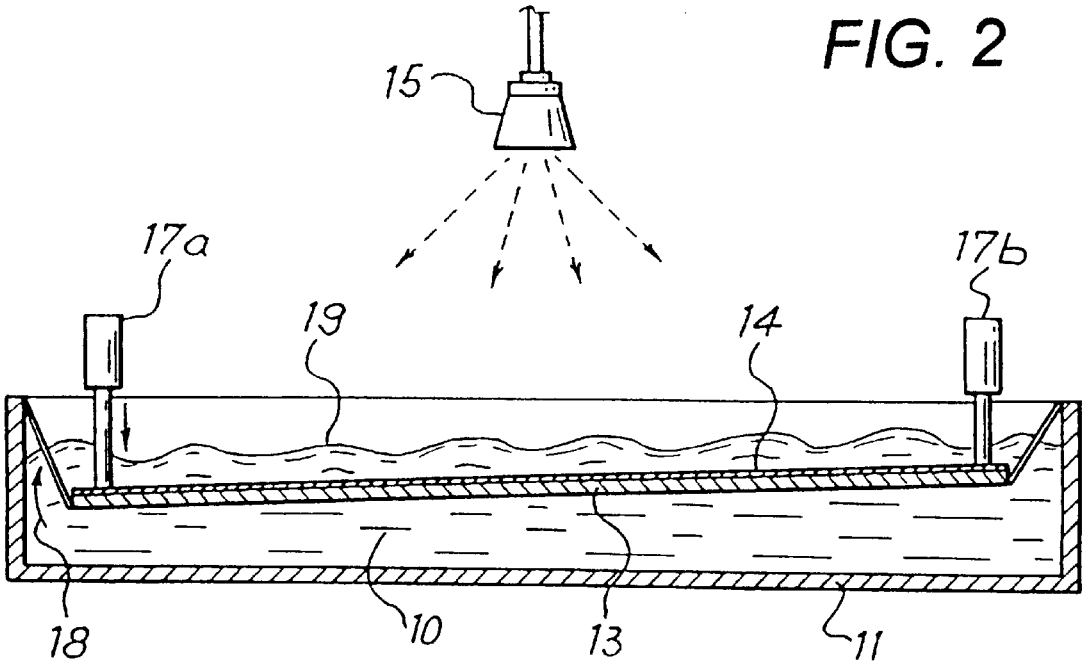
FIG. 2 is a schematic representation of the device of FIG. 1, in one of the potential operative conditions thereof.

FIG. 2 shows schematically one of the potential operative conditions of the device shown in FIG. 1. The vertical impulse, directed downwards, imparted on the planar element 13 at a place near its outer edge and produced by a driving mechanism such as e.g. the actuation rod 17*a*, causes a larger depth of immersion of the downwardly pushed portion of the planar element 13 with respect to the unactivated portion beneath the other driving mechanism such as e.g. another actuation rod or piston 17*b* which has not been activated. The downward movement of the planar element 13 generates a reflux of liquid indicated by an arrow 18, said reflux producing waves 19 above the planar element 13.

The motion of the waves 19 is projected on one or more surfaces by means of the light beam generated by the light source comprised in the optical device 15. The result is schematically shown in FIG. 3.

Figure 3:
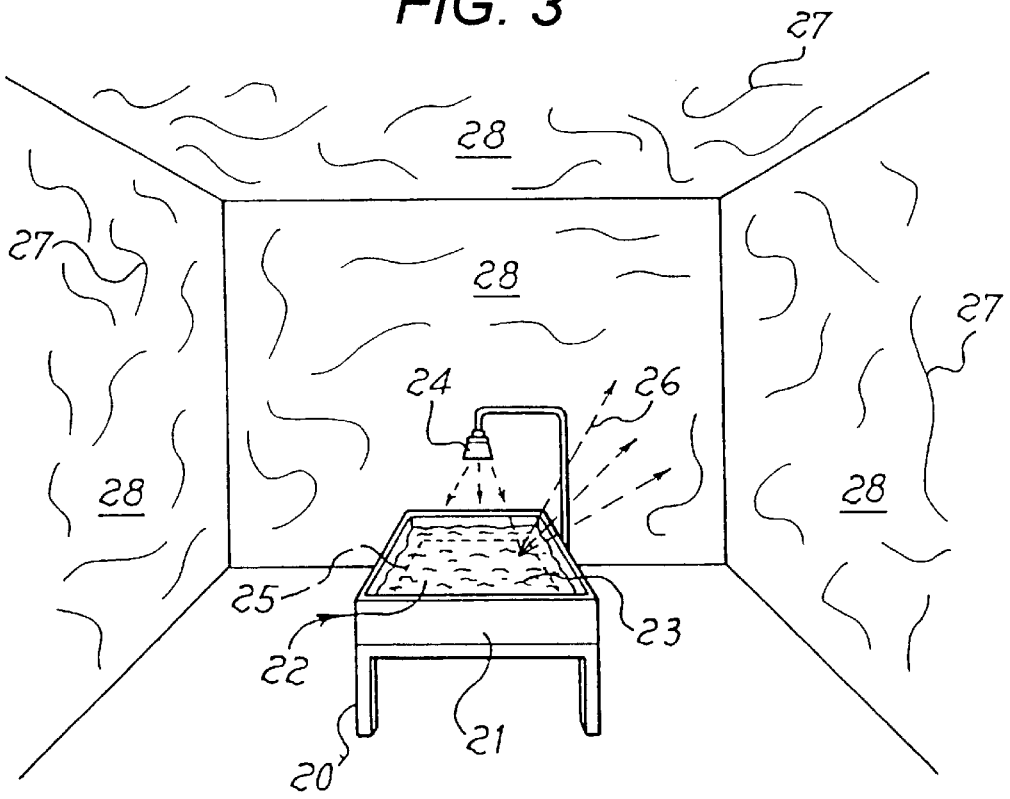
FIG. 3 is an overall perspective view of the device from FIGS. 1 and 2, in cooperation with surrounding walls acting as projection screens.

In the embodiment of the present invention illustrated in FIG. 3 a container 21 of liquid is mounted on a frame 20 and filled with liquid 22, and waves 23 are generated in said liquid as previously described. Said liquid waves 23 are illuminated by the light beam generated by a light source comprised in an optical device 24, said light beam being reflected by the mirror 25 placed on the upper surface of said planar element 13 (FIGS. 1,2). The reflected light beam 26 reproduces the waves' design patterns on surfaces 28 acting as screens, such as e.g. the walls in a room or a suitable scenographic set-up.

The planar element 13 (FIGS. 1,2) constitutes a fundamental characteristic of the system of the present invention, in view of the motion imparted by the driving mechanisms placed in proximity of the outer edge of the planar element; this motion allows to continuously change the thickness of the layer of liquid above the said planar element and its inclination with respect to the surface of the liquid.

Planar element 13 (FIGS. 1,2) basically functions as a moving bottom at variable depths; as the motion patterns of the liquid waves also depend on the depth of the liquid and on the inclination of the bottom, the present invention enables to obtain a great variety of light-projected wave design patterns.

In accordance with the teachings of the present invention the planar element 13, combined with the associated motion drive mechanisms preferably but not necessarily constitutes the element generating the waves (19, FIG. 2; 23, FIG. 3). In this case the power of the motion drive-mechanisms for the planar element 13 should be sufficient to enable, if desired, a rapid vertical displacement of the outer edge of the planar element 13 against the resistance exercised by the liquid. The liquid then flows abruptly, in a turbulent condition, over the upper face of said planar element 13, and interfering waves designs will be generated thereby, an important feature of the system and of great attractiveness.

Figure 4:
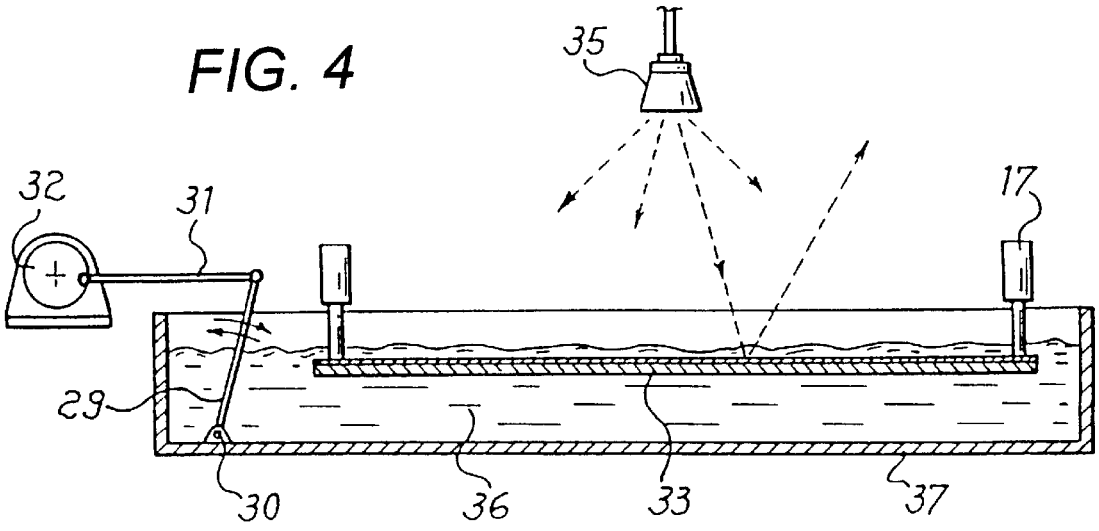
FIG. 4 depicts a device similar to the one shown in FIGS. 1 and 2 and in a similar view, additionally comprising separate wave generator means, FIGS. 5A–5D representing schematic simplified sectional views exemplify various wave patterns obtained with the system of this invention, FIG. 6 in partially sectional side view shows in greater technical detail a system embodying the invention, with associated drive and control means for actuation of the movable planar element.

Alternatively, waves can be generated by means of conventional wave generators integrated to a higher or lower degree with the motion of the planar element 13 as schematically represented, as an example, in FIG. 4.

A wave generating oscillatory motion is imparted to a plate 29 (FIG. 4) immersed in the liquid 36 in the container 37; plate 29 is rotatably mounted around an axis 30, plate 29 being connected by an arm 31 to an electric motor 32. By changing or varying the position and inclination of the planar element 33 relative to the surface of the liquid 34 a great variety of wave design shapes can be obtained which are projected by means of the light source in the optical device 35.

Other wave generation devices than the one specifically described and shown in FIG. 4 are known in the hydraulic art and are within the scope of the present invention.

Further, the present invention is not limited to utilizing only one single wave generation device; more than one wave generation devices can be provided arranged around the perimeter or edge of the container of liquid whereby to obtain waves in a multiplicity of directions, and a higher variety of interference phenomena between them.

As exemplary of the variety of wave patterns obtainable in accordance with the present invention four different situations will now be schematically described related to the case where the motion of the planar element 13 (FIGS. 1,2) is the only wave generating mechanism, i.e. no additional or separate wave generator like the one shown in FIG. 4 (and indicated by reference numbers 29, 30, 31, 32) is used.

Figure 5A:
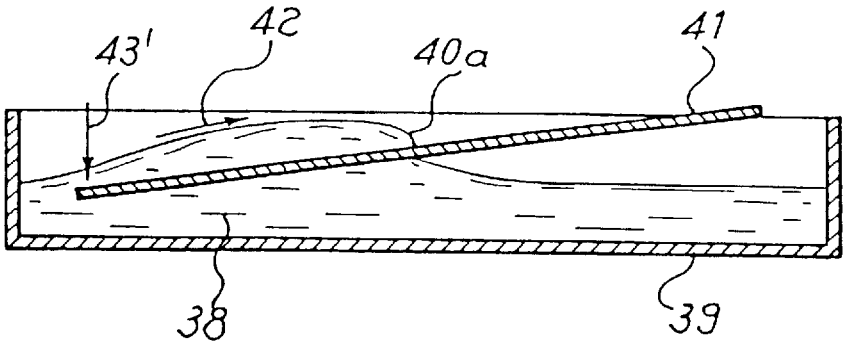

FIG. 5A shows a 'positive surge' or 'translational' wave 40*a* (i.e. a displacement of liquid in the propagation direction) such as a backwash wave which is formed on the upper side or surface of the planar element 41 provided in the container of liquid 39. Arrow 42 indicates the direction of the wave motion while arrow 43' indicates the displacement of the planar element 41 causing or producing the wave.

Figure 5B:
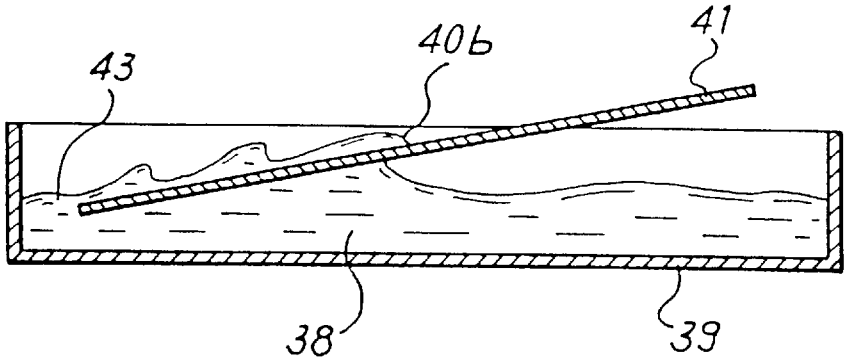
Figure 5C:
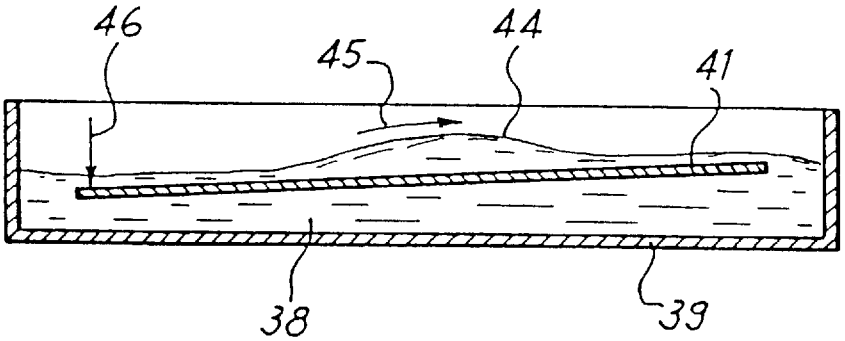

FIG. 5B indicates a situation similar to the one described in FIG. 5A but in a case where the vertical displacement of the planar element is much more pronounced: the 'positive surge' wave 40*b* is combined or superposed with turbulence phenomena 43. FIG. 5C shows a wave pulse 44 propagating along the direction of arrow 45 and generated by the displacement 46 of the completely immersed planar element 41.

Figure 5D:
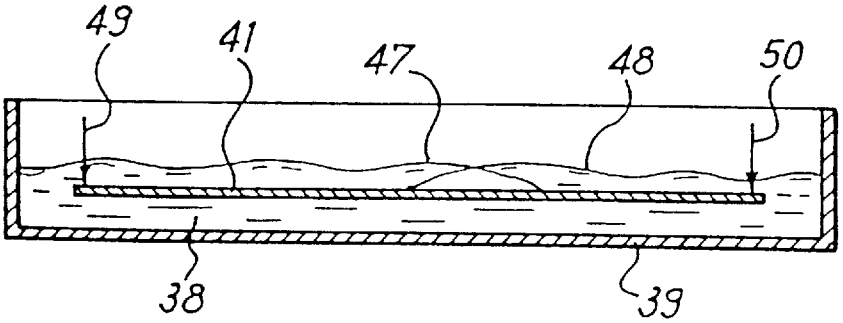

FIG. 5D shows wave pulses 47,48 originating from opposite directions and interfering with one another; the waves are generated by the abrupt lowering of the planar element 41 as indicated by arrows 49,50. In any case it becomes apparent that a huge variety of projected design patterns of moving waves can be obtained following the procedure of the present invention, as a result of the large variety of positions and motion behaviours of the planar element (13, FIGS. 1,2; 33, FIG. 4; 41, FIG. 5). In this respect, FIG. 5 shows only a few examples which should not be interpreted in a limitative manner.

Figure 6:
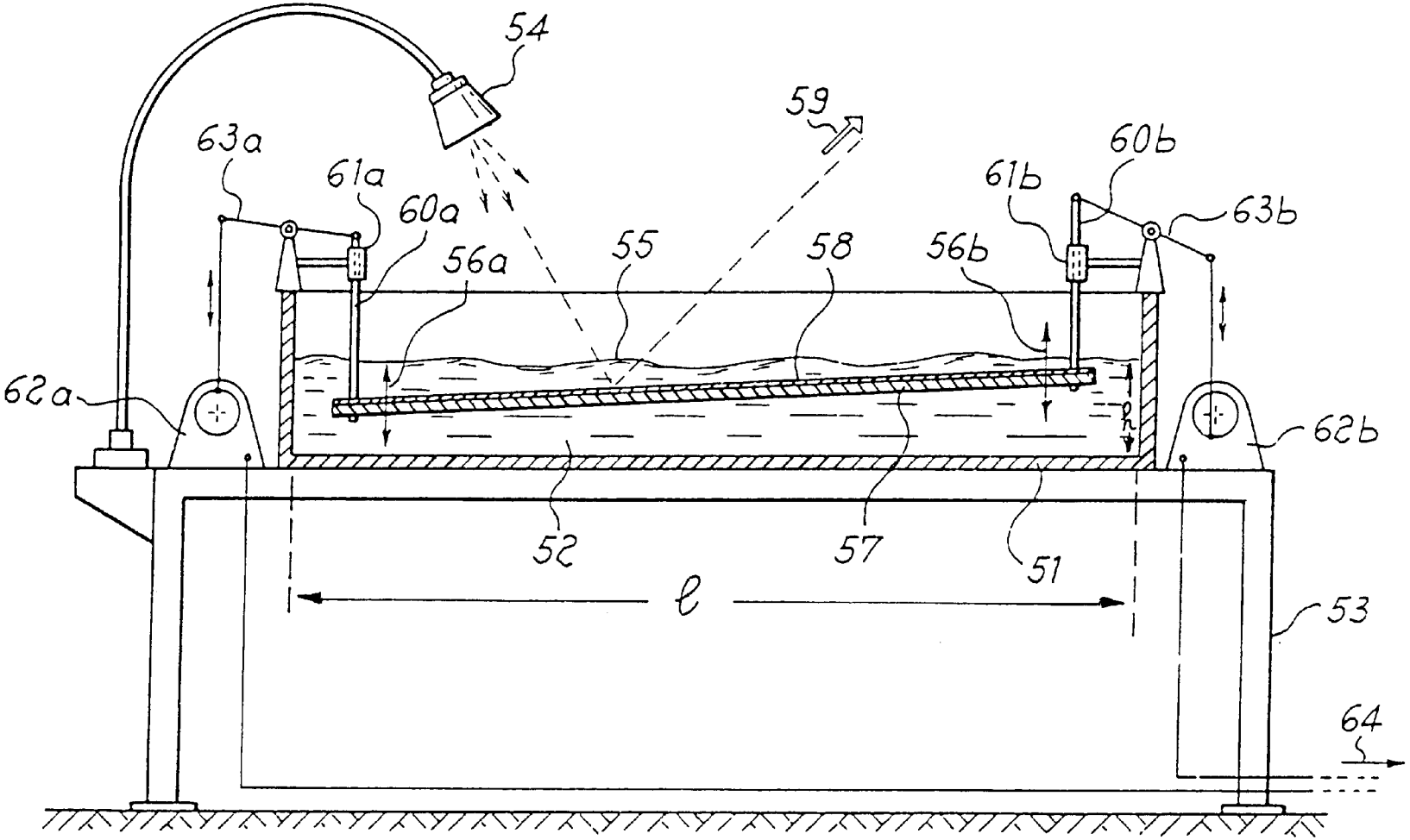

FIG. 6 shows in greater technical detail, and again only as an example, one embodiment in accordance with the present invention.

A container 51 of liquid 52 is supported by a frame 53. A light source included in an optical device 54 is arranged to project a light beam on the waves formed on the water surface 55 as a result of movements 56*a,b* of the planar element 57 covered on its upper face by a mirror-like surface 58; thus said light beam is reflected in directions indicated by arrow 59 toward the wall-screens on which the moving waves designs or patterns are visualized.

The displacements or motions imparted to the planar element 57 are produced by actuating rods or pistons 60*a*, 60*b* which are slidably movable in guide bearings 61*a*, 61*b*.

The drive motion of the rods 60*a*, 60*b* is generated by electromotors 62*a*, 62*b* drivingly connected through linkages 63*a*, 63*b*. The electromotors 62*a*, 62*b* are connected to a control-unit 64, which may be a computer. The liquid considered in this example is water. For some examples of embodiments the dimension 'l' (FIG. 6) will preferably be larger than 30–40 cm, the depth of the liquid 'h' being also very small, generally higher than 2 cm, in the case of water or similar liquids. The following comments can be made regarding the individual components of systems realized in accordance with the present invention.

The optical device (15, FIGS. 1,2,4; 24, FIG. 3; 35, FIG. 4; 54, FIG. 6) incorporating the light source can be selected either for direct projection of the waves, or for imaging projection of the waves by adding one or more lenses arranged along the light rays path, in a position comprised between the site of the waves and the site of the wall-screen on which the images of said waves are formed. In the first case, as a non-limitative example, a suitable 100 W halogen light source may be arranged at a distance of 50 cm from the surface of the liquid, and would generate excellent images at a distance of 4–5 m in an ambient darkness condition.

In the second case the optical system may conveniently but not necessarily be designed in such manner that the surface of the liquid is positioned in the convergent path of the light rays impinging on the projecting lens (or lenses). Furthermore, for given distances more powerful light sources should preferably be selected.

The specific position of the light source included in the optical device (15, FIGS. 1,2,4; 24, FIG. 3; 35, FIG. 4; 54, FIG. 6) relative to the surface of the waves will depend on the specific selected geometry of the system. It should be noted that the invention encompasses embodiment designs where the light rays pass through the layer of liquid beneath the planar element (13, FIGS. 1,2; 33, FIG. 4; 41, FIG. 5; 57, FIG. 6). This situation occurs either in cases where the light source is placed beneath the container of liquid (11, FIGS. 1,2; 21, FIG. 3; 37, FIG. 4; 39, FIG. 5; 51, FIG. 6) in which case the direction of the light ray paths will be upwards and the bottom of the container of the liquid and said planar element both should be fully transparent, the latter having no mirror-like surface; or in the opposite case, i.e. where the light source is placed above the container of liquid. The first configuration will be more suitable for projections in the upward direction, such as on ceilings, the second configuration for downwards projections, such as on floors, with the system being arranged at a sufficiently high or elevated level, e.g. close to the ceiling.

In accordance with other configurations of the invention the mirror-like surface may be provided on the bottom of the liquid container of liquid rather than on said planar element.

It will also be seen that in some cases it may be advantageous to reorient the light beams emitted by the light source in the optical device (15, FIGS. 1,2,4; 24, FIG. 3; 35, FIG. 4; 54, FIG. 6) by means of additional mirrors provided along the optical path of the light rays.

The shape and size of the planar element (13, FIGS. 1,2,3; 33, FIG. 4; 41, FIG. 5; 57, FIG. 6) will be determined by the shape and size of said liquid container, an entirely non-limitative example being a circular shape of the planar element for use in a container of liquid with the same shape and a slightly larger diameter. The planar element should be sufficiently rigid to resist the mechanical stress generated by the driving mechanisms without suffering permanent deformations; e.g. the planar element can be made of a suitable plastic material or a metal resistant to the selected liquid.

In general the planar element will have a flat surface except if more pronounced backwash effects are desired, in which case the said surface can be slightly convex in the upward direction; or alternatively, if more pronounced reflux effects are desired, in which case, conversely the said surface can be slightly convex in the downward direction. Other shapes of said planar element are also possible provided a sufficient degree of planarity is maintained in order to avoid impairing the effectiveness of the method.

Figure 7:
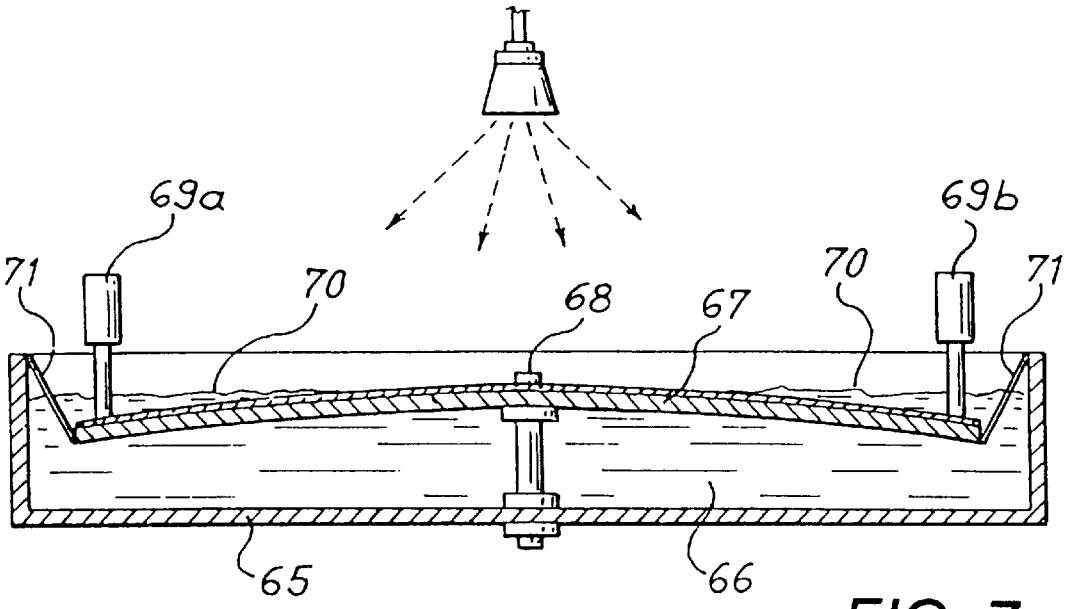
FIG. 7 shows in a schematic sectional side view similar to FIGS. 1 and 2 a device in accordance with a further embodiment including a particular support scheme for said movable planar element.

In this context FIG. 7 exemplifies a structure embodying a particular arrangement of said planar element. A flexible planar element 67 within a container 65 filled with liquid 66 is fixedly connected to a pin 68 at one point of its surface, preferably but not necessarily its geometrical center. Thereby at this point the planar element 67 is kept at a constant distance with respect to the bottom of the container and the level of the liquid. By suitably selecting the constituent material of the planar element 67 as to its flexibility or resiliency, actuation of the pushing rods or pistons 69*a*, 69*b* will cause the formation of very attractive backwash effects which can be visualized by luminous projection. Actuation of the pushing rods or pistons, and the luminous projection will take place in accordance with the general teachings of the present invention set out above. An example of the planar element 67 (FIG. 7) meeting the flexibility requirements is a circular disk made of polymethyl metacrylate having a diameter of 1 m and a thickness of 5 mm. Said planar element 67 can additionally be connected or linked to the edges or side walls of the container 65 of liquid by means of elastic elements 71.

So far, only a single planar element (13, FIGS. 1,2; 33, FIG. 4; 41, FIG. 5; 57, FIG. 6, 67, FIG. 7) arranged in a single container liquid (11, FIGS. 1,2; 21, FIG. 3; 37, FIG. 4; 39, FIG. 5; 51, FIG. 6; 65, FIG. 7) has been considered as part of the embodiment structures of the present invention described so far. However, the person skilled in the art will readily realize that configurations comprising more than one planar element in the same said container of liquid are well within the scope of the present invention, thereby further increasing the variety of visual effects obtainable by the present invention. In this respect, an interesting particular design configuration would be a planar surface which is divided into contiguous portions, each portion being subject to driving action by one or more driving mechanisms as previously described whereby each portion would be movable more or less independently from the contiguous ones. E.g. the contiguous edges of two contiguous portions could be linked or connected with one another by means of elastic elements in order to reduce or limit the independency of motion behaviour of the two contiguous portions in case the actuation drives operate too abruptly. This configuration, too, embodies the basic idea of the present invention, i.e. the fact that said planar element, constituted by a single integral body or, alternatively, by a configuration comprising a plurality of contiguous planar surface portions, with respect to the layer of liquid above it, functions as a moving bottom at variable depth; the expression 'moving bottom' thus encompasses the capability of relative motion of various single portions of said over-all planar element with respect to the other contiguous portions of the same planar element.

The mechanical driving or actuation mechanisms for said planar element can be of various different kinds, other than those previously described; examples of such alternative drive systems include other mechanical motion mechanisms driven by electric motors, pneumatic systems, hydraulic systems and other systems well known in the art of mechanical motion drive or actuation systems. As an example, with an embodiment corresponding to the configuration schematically shown in FIG. 6, using water as the liquid 52, 'l' measuring 70–100 cm and 'h' approximately 5 cm, good results have been obtained with low voltage (12 V) dc electric motors with power consumptions comprised between 50 and 100 W depending on the specific wave patterns desired (as an example, the electric motor used could be the model Bosch WXP series 0390).

The number of actuation or drive points on the planar element (13, FIGS. 1,2; 33, FIG. 4; 41, FIG. 5; 57, FIG. 6) may vary in dependence on the degree of sophistication and of the cost of the embodiment considered: for some practical uses a single driving mechanism will be acceptable while in other cases three mechanisms might be provided at three potentially equidistant points around the perimeter of said planar element in order to obtain any desired spatial orientation of the planar element. In other cases an even higher number might be provided with a view to reduce the dimensions of the mechanical parts at each actuation or drive point.

A specific and particularly interesting variation included within the scope of the present invention concerns the possibility of manually moving said planar element. It will be clear that this modified embodiment relates to situations of non-continuous use such as in the case of shows or events the importance of which justifies the elevated cost of a particular operator; this method has the advantage that manual actuation is highly capable of optimally grading or controlling the amount or force of drive or actuation applied on said planar element and modify same in time, changing also the points or sites of drive actuation. Also, there may be situations where a plurality of persons from the public will manually act at the same time on the same projection device of the present invention, each person manually operating on a different point along the edge or perimeter of said planar element, in accordance with the general trend towards a more interactive behaviour or participation by the public.

Figure 8:
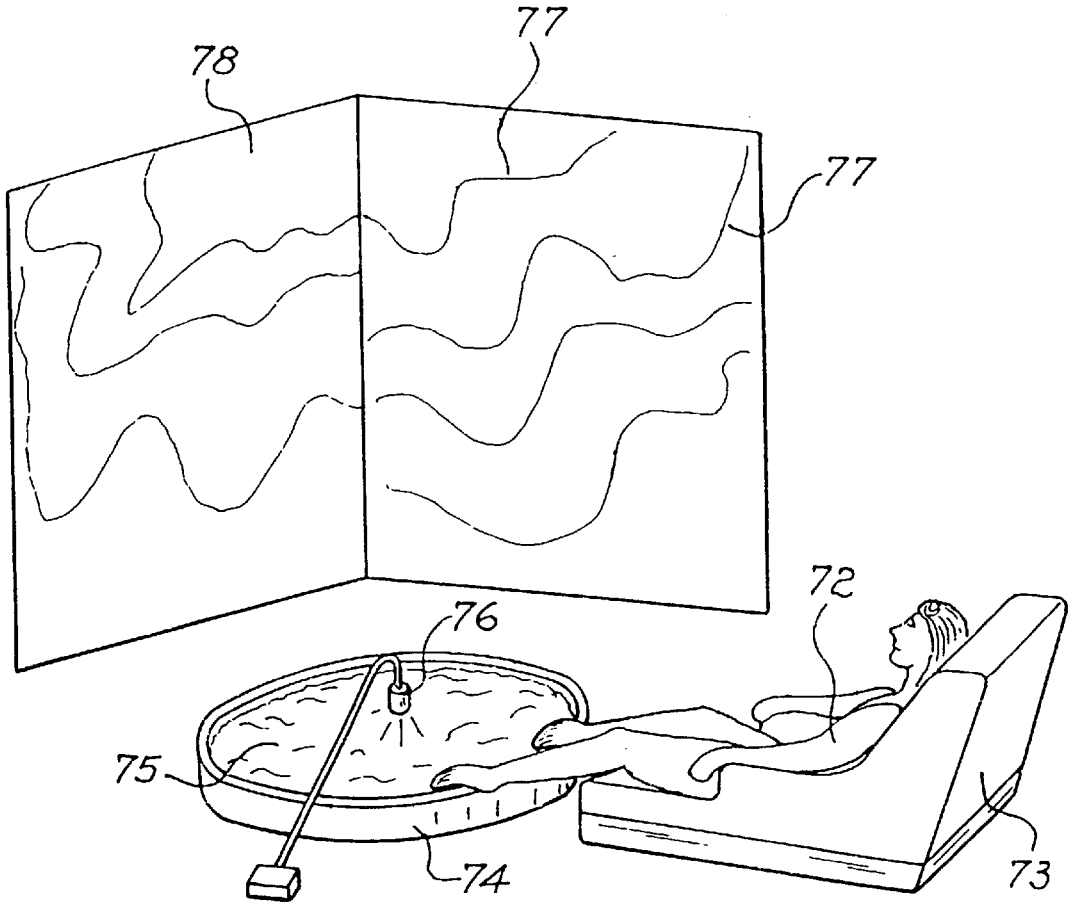
FIG. 8 is a schematic perspective view exemplifying utilization of the system of the present invention in the context of, and associated with, a relax system integrating a person or user as an active component in the system of the present invention.

Other interesting applications of the present invention, which possibly but not necessarily may involve physical action or contribution by an operator for moving said planar element, relate to the innovative field of relax and wellness equipment as it is increasingly used in spas, wellness and fitness centers. More advanced relax (or anti-stress) equipment combines in a harmonic way coloured light, sound and, sometimes, soft physical exercise. Embodiments of the present invention for 'relaxing' purposes are of great interest because they may combine the visual perception of an endless variety of visually perceived wave motion design patterns with the sound of the liquid moving in the container. As the current trend is the combination of perception of harmonic phenomena and soft physical exercise, a very interesting way to utilize the present invention is to physically operate or actuate the device, i.e. to apply the needed driving pressure onto said planar element; this is a soft physical exercise, combined with the visual and acoustical perception of the result of this action, i.e. the projected liquid wave motions and the sound of the wave's motions in the container of liquid. As already mentioned one possible way of physically acting on the planar element is manually with the hands. Another possibility, which is also included within the scope of the present invention, relates to pedally actuating the device, i.e. with the feet. An example of such pedal application, i.e. use of the feet is a 'relax-room', as shown in FIG. 8: a person 72 is comfortably sitting in an arm-chair 73 with his body stretched out in a relaxed position and looking in an upward direction. The container of liquid 74 comprising the planar element 75 is placed on the floor or close to the floor and in front of the arm-chair in order that the person's feet are resting either on a support mechanically connected or linked to the driving mechanisms of said planar element or directly on the planar element, depending on the specific technical structure or embodiment according to the present invention; this modification has the additional advantage of providing direct physical contact with the liquid, which can be an additional pleasant and beneficial effect, if e.g. the liquid is water at a suitable temperature. A light source provided in the optical device 76 generates a light beam reflected by the mirror-like surface of the planar element, the liquid waves design patterns 77 being visible on the wall-screen 78. In this context it is important to note that 'relax rooms' are already in normal use in spas and wellness centers and generally include an arm-chair or soft exercise equipment and technical means for visual and acoustic stimulation: In this connection the novel result obtainable with the present invention becomes even more conspicuous if the selected liquid is water; this ingenuity consists, and is due to, the 'natural' quality of the images and sound generated by the natural element water, images of an unending variety and high aesthetic appeal, combined with the interactivity involved in the situation, i.e. the person generates and varies the images and sound by physically acting on the projection device, specifically on the component therein generating the motion of the liquid, a pleasant and soft physical effort. Regarding this particular application or field of use of the present invention it is apparent that other design variations or embodiments are included in the scope of the present invention, such as e.g. activation with the feet (instead of by electric motors) of wave generators such as those previously described and shown in FIG. 4 (29, 30, 31, FIG. 4). Water will be the preferred selected liquid (10, FIGS. 1,2; 22, FIG. 3; 36, FIG. 4; 38, FIG. 5; 52, FIG. 6; 66, FIG. 7) if a high degree of 'naturalness' of the projected images is desired, similar to wave motions in nature. Otherwise other liquids of suitable viscosity and surface tension can be selected; in the case of embodiments comprising very powerful light sources liquids of high thermal resistance can be selected, such as e.g. some kinds of transparent liquid synthetic resins.

As an important facet of the present invention provision could be made for recording the wave images created on the screen in accordance with the teachings of the present method, for subsequent reproduction on walls suitable to act as screens, such recording could be effected e.g. by means of recording equipment like a video camera, and the subsequent reproduction operation could be carried out by means of projection techniques like TV-projection or other visualization techniques of prerecorded images. These recordal/replay procedures are clearly within the scope of the present invention.

The present invention has been described herein as to the basic principles thereof and by means of preferred embodiments and applications of the principle. Further modifications and applications than those specifically and explicitly described will be apparent to scenographers, architects, creative professionals and other experts in the field, within the domain of the present invention which is governed by the basic idea of obtaining scenographic and decoration effects visualized on surfaces of various nature, size, shape and orientation, apt to perform as screens, such effects consisting in the visualization of waves of a suitable liquid, an example being water, and said effect being produced by the luminous projection by means of a light source, in conjunction with traditional optical means, if desired or needed, of the movement of said waves of said liquid, said waves being generated by mechanical action on said liquid in a suitable container and said waves showing a great variety of variable shapes and design-patterns as they are formed above a movable planar element comprised in said container, said movable planar element actuated on by mechanical means or manually, to modify its inclination, spatial orientation, depth with respect to the surface of said liquid and distance from the bottom of said container, the energy applied to said movable planar element during actuation thereof preferably, but not necessarily, being the originating cause of the generation of said waves.

I claim:

1. A system for obtaining visual effects on surfaces adapted for use as screens for scenographic, decorative, and architectural surfaces, comprising:

a container of liquid;

a movable planar element placed inside said container;

actuating means for variably displacing said movable planar element relative to the liquid to generate a variety of movements of waves above the upper face of the movable planar element;

a light source placed relative to said container to project the movements of the waves onto the surfaces; and additional wave generator means provided associated with said movable planar element, for generating said waves.

2. A system for obtaining visual effects on surfaces adapted for use as screens for scenographic, decorative, and architectural surfaces, comprising:

a container of liquid, wherein said liquid container includes side wall portions;

a movable planar element placed inside said container wherein said movable planar element includes perimeter portions;

actuating means for variably displacing said movable planar element relative to the liquid to generate a variety of movements of waves above the upper face of the movable planar element;

a light source placed relative to said container to project the movements of the waves onto the surfaces; and support means for supporting said movable planar element within said liquid in a position substantially parallel to the liquid surface in the unactivated condition of the system, wherein said support means comprise elastic elements connecting said perimeter portions of said movable planar element with said side wall portions of said liquid container.

3. The system of claim 2, wherein said support means for said movable planar element include connecting means for fixedly connecting at least a point of said movable planar element to a portion of said liquid container, said movable planar element having flexibility or resiliency characteristics enabling said variable displacements thereof under the action of said actuating means, notwithstanding said fixed connection of said movable planar element to said liquid container.

4. A system for obtaining visual effects on surfaces adapted for use as screens for scenographic, decorative, and architectural surfaces comprising:

a container of liquid;

a movable planar element placed inside said container, wherein said movable planar element has an upper face;

actuating means for variably displacing said movable planar element relative to the liquid to generate a variety of movements of waves above the upper face of the movable planar element;

a light source placed relative to said container to project the movements of the waves onto the surfaces;

illumination devices incorporating said light source, said illumination devices being mounted above said liquid container in a position to suitably illuminate said wave patterns formed in said liquid above said movable planar element so as to reflect light beams therefrom, the reflected light beams projecting said wave patterns onto said wall or screen surfaces; and a reflective mirror surface provided on the upper face of said movable planar element.

5. A system for obtaining visual effects on surfaces adapted for use as screens for scenographic, decorative, and architectural surfaces, comprising:

a container of liquid;

a movable planar element placed inside said container, wherein said movable planar element is made of a transparent material;

actuating means for variably displacing said movable planar element relative to the liquid to generate a variety of movements of waves above the upper face of the movable planar element;

a light source placed relative to said container to project the movements of the waves onto the surfaces;

illumination devices incorporating said light source, said illumination devices being mounted above said liquid container in a position to suitably illuminate said wave patterns formed in said liquid above said movable planar element so as to reflect light beams therefrom, the reflected light beams projecting said wave patterns onto said wall or screen surfaces; and a reflective mirror surface provided on the upper face of the bottom of said liquid container.

6. A relaxation system comprising:

(a) a system for obtaining visual effects on surfaces adapted for use as screens for scenographic, decorative, and architectural surfaces comprising:

a container of liquid;

a movable planar element placed inside said container;

actuating means for variably displacing said movable planar element relative to the liquid to generate a variety of movements of waves above the upper face of the movable planar element; and a light source placed relative to said container to project the movements of the waves onto the surfaces;

(b) seating equipment functionally associated with said visual effect system in a manner as to enable a user to actuate said visual effects system; and (c) a sound recordation and reproduction channel for recording and subsequent reproduction of the sound of said moving liquid waves.

7. A system for obtaining visual effects on surfaces adapted for use as screens for scenographic, decorative, and architectural surfaces, comprising:

a container of liquid, said container having a bottom and said liquid having a surface above said bottom of said container;

a planar element placed inside said container, said planar element having a planar upper face facing said surface of said liquid and being movable relative to said bottom of said container and having an inclination which is variable relative to said bottom of said container so as to function as a moving bottom at variable depths of said liquid;

actuating means for variably displacing and inclining said movable planar element relative to said surface of the liquid and said bottom of said container to generate a variety of movements of waves above the upper face of the movable planar element; and a light source placed relative to said container to project the movements of the waves onto the surfaces.

8. The system of claim 7, further comprising support means for supporting said movable planar element within said liquid in a position substantially parallel to the liquid surface in the unactivated condition of the system.

9. The system of claim 8, wherein said support means for said movable planar element include connecting means for fixedly connecting at least a point of said movable planar element to a portion of said liquid container, said movable planar element having flexibility or resiliency characteristics enabling said variable displacements thereof under the action of said actuating means.

10. The system of claim 7, wherein said actuating means for said movable planar element comprise a drive selected from the group of mechanically, electrically, magnetically, electro-magnetically or hydraulically driven drive or actuating rods or pistons acting on edge portions, of said movable planar element.

11. The system of claim 10, wherein said drive or actuating rods or pistons are also effective to support said movable planar element.

12. The system of claim 10, further comprising electronic control units, energizing of said actuation means being controlled by said electronic control units.

13. The system of claim 7, further comprising illumination devices incorporating said light source, said illumination devices being mounted above said liquid container in a position to suitably illuminate said wave patterns formed in said liquid above said movable planar element so as to reflect light beams therefrom, the reflected light beams projecting said wave patterns onto said wall or screen surfaces.

14. The system of any of claim 7, wherein said liquid container includes a bottom, and wherein the bottom of said liquid container and said movable planar element are made of a transparent material, and wherein the system further comprises illumination devices incorporating said light source mounted below said liquid container in a position to suitably illuminate from below said moving wave patterns formed in said liquid above said movable planar element to transmit light beams, the transmitted light beams projecting said wave patterns onto said surfaces.

15. The system of claim 7, wherein said liquid is water.

16. The system of claim 7, wherein said container has an open top, and said movable planar element is adapted for manual actuation by at least one person via said open top of said container.

17. The system of claim 7, wherein said container has an open top and said movable planar element is adapted for actuation in dependence on a physical exercise effort by at least one person via said open top of said container.

18. A system for obtaining visual effects on surfaces adapted for use as screens for scenographic, decorative, and architectural surfaces, comprising:

a container of liquid;

a movable planar element placed inside said container;

a plurality of actuating means for variably displacing said movable planar element relative to the liquid to generate a variety of movements of waves above the upper face of the movable planar element;

a light source placed relative to said container to project the movements of the waves onto the surfaces; and electronic control units, energizing and synchronizing of said actuation means being controlled by said electronic control units.

19. A relaxation system comprising:

(a) a system for obtaining visual effects on surfaces adapted for use as screens for scenographic, decorative, and architectural surfaces, comprising:

a container of liquid, said container having a bottom and said liquid having a surface above said bottom of said container;

a planar element placed inside said container, said planar element having a planar upper face facing said surface of said liquid and being movable relative to said bottom of said container and having an inclination which is variable relative to said bottom of said container so as to function as a moving bottom at variable depths of said liquid;

actuating means for variably displacing and inclining said movable planar element relative to said surface of the liquid and said bottom of said container to generate a variety of movements of waves above the upper face of the movable planar element; and a light source placed relative to said container to project the movements of the waves onto the surfaces; and (b) seating equipment functionally associated with said visual effect system in a manner as to enable a user to actuate said visual effects system.

* * * * *